US009240174B2

(12) United States Patent
Suenaga et al.

(10) Patent No.: US 9,240,174 B2
(45) Date of Patent: Jan. 19, 2016

(54) ELECTRIC STRINGED MUSICAL INSTRUMENT AND METHOD OF DESIGNING THE SAME

(71) Applicant: Yamaha Corporation, Hamamatsu-Shi, Shizuoka-Ken (JP)

(72) Inventors: Yuichiro Suenaga, Hamamatsu (JP); Shinya Tamura, Hamamatsu (JP); Masao Noro, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 2 days.

(21) Appl. No.: 14/154,818

(22) Filed: Jan. 14, 2014

(65) Prior Publication Data

US 2014/0196594 A1 Jul. 17, 2014

(30) Foreign Application Priority Data

Jan. 15, 2013 (JP) ..... 2013-004833

(51) Int. Cl.

| | |
|---|---|
| ***G10D 3/02*** | (2006.01) |
| ***G10D 3/04*** | (2006.01) |
| ***G10H 3/18*** | (2006.01) |
| ***G10H 3/14*** | (2006.01) |
| *G10D 1/08* | (2006.01) |

(52) U.S. Cl.

CPC .. *G10H 3/18* (2013.01); *G10D 3/02* (2013.01); *G10H 3/14* (2013.01); *G10H 3/181* (2013.01); *G10H 3/182* (2013.01); *G10H 3/185* (2013.01); *G10D 1/085* (2013.01); *G10D 3/04* (2013.01); *G10H 2220/471* (2013.01); *Y10T 29/42* (2015.01)

(58) Field of Classification Search

CPC ..... G10D 3/02; G10D 3/04; G10H 3/14; G10H 3/18; G10H 3/181; G10H 3/182; G10H 3/185; G10H 2220/471

USPC ..... 84/294, 726, 731; 984/371; 29/25.35

See application file for complete search history.

(56) References Cited

U.S. PATENT DOCUMENTS 2,271,460 A * 1/1942 Miessner ..... G10C 3/16 84/236
3,069,955 A * 12/1962 Burkhard ..... G10C 3/04 84/211

(Continued)

FOREIGN PATENT DOCUMENTS

DE 327157 C 10/1920
DE 10 2010 004533 A1 7/2011

(Continued)

OTHER PUBLICATIONS

Extended European Search Report issued for EP 14151263.2, mailing date Apr. 3, 2014.

*Primary Examiner* — David Warren
*Assistant Examiner* — Christina Schreiber
(74) *Attorney, Agent, or Firm* — Dickstein Shapiro LLP

(57) ABSTRACT

An electric stringed musical instrument includes: a string which vibrates by a performance operation; a body which supports the string via a bridge; a pickup sensor mounted on a portion which vibrates by a vibration of the string, the pickup sensor being configured to detect a vibration having propagated from the string and output an electric signal; a supporter having a spring structure which supports the bridge with respect to the body; and a damper mounted on a portion which vibrates by a vibration of the string, the damper being configured to damp a vibration of the bridge.

14 Claims, 11 Drawing Sheets

(56) References Cited

U.S. PATENT DOCUMENTS 3,470,305 A * 9/1969 Martin ..... G10C 3/06 84/723
3,563,125 A * 2/1971 Brocato ..... 84/237
3,595,981 A * 7/1971 Hopping ..... G10H 3/185 84/726
3,685,384 A * 8/1972 Martin ..... G10H 3/185 84/211
3,779,125 A * 12/1973 Quitmeyer ..... G10C 3/06 84/189
4,211,139 A * 7/1980 Murakami ..... G10H 3/185 84/731
4,218,951 A * 8/1980 Tressel ..... G10D 3/02 84/294
4,378,721 A * 4/1983 Kaneko ..... G10H 3/185 252/62.9 R
4,567,805 A * 2/1986 Clevinger ..... G10H 3/185 84/731
4,635,523 A * 1/1987 Merchant ..... G10D 3/04 84/307
4,738,178 A * 4/1988 Deering ..... G10H 3/182 84/171
4,947,726 A * 8/1990 Takabayashi ..... G10H 3/18 84/723
5,078,041 A * 1/1992 Schmued ..... G10H 3/185 84/731
5,123,326 A * 6/1992 Clevinger ..... G10D 1/085 84/723
5,763,803 A * 6/1998 Hoshiai ..... G10H 1/0091 84/626
5,911,171 A * 6/1999 Wong ..... G10D 3/04 84/274
6,008,440 A * 12/1999 Yamada ..... G10H 3/18 84/291
6,031,164 A * 2/2000 Murakami ..... G10D 3/04 84/294
6,271,456 B1 * 8/2001 Nelson ..... G10H 3/181 84/726
7,339,106 B2 * 3/2008 Tamura ..... G10H 3/146 84/723
8,658,879 B2 * 2/2014 Gillette ..... G10H 3/185 84/723
2006/0117938 A1 * 6/2006 Gillette ..... G10H 3/185 84/723
2007/0028752 A1 * 2/2007 McGrew ..... G10H 3/143 84/726
2007/0209496 A1 * 9/2007 Lenzi ..... G10D 3/046 84/313
2007/0295195 A1 * 12/2007 Tamura ..... G10H 3/185 84/731
2008/0105101 A1 * 5/2008 Eldring ..... G10D 1/085 84/291
2009/0173208 A1 * 7/2009 Tamura ..... G10D 3/12 84/302
2010/0307313 A1 * 12/2010 Zoran ..... G10D 1/085 84/192
2011/0226118 A1 * 9/2011 Kuroki ..... G10H 1/125 84/735
2011/0277614 A1 * 11/2011 Aspri ..... G10D 3/02 84/294
2012/0103171 A1 * 5/2012 Lashbrook ..... G10D 3/04 84/731
2013/0112069 A1 * 5/2013 Weinreich ..... G10H 3/185 84/731
2013/0269505 A1 * 10/2013 Nakatani ..... G10H 3/185 84/731
2014/0196594 A1 * 7/2014 Suenaga ..... G10H 3/18 84/731
2014/0196595 A1 * 7/2014 Suenaga ..... G10H 3/185 84/731

FOREIGN PATENT DOCUMENTS

GB 422735 A 1/1935
JP S49-131110 A 12/1974
JP S55-83097 A 6/1980
JP S58-35596 A 3/1983
JP S60-154299 A 8/1985
JP H09-127952 A 5/1997
JP H09-244636 A 9/1997
JP 3225856 B2 11/2001
JP 3553059 B1 8/2004
JP 2007-333786 A 12/2007
JP 4259429 B2 4/2009
JP 2011-197325 A 10/2011
JP S55-38323 A 7/2014

* cited by examiner

ELECTRIC STRINGED MUSICAL INSTRUMENT AND METHOD OF DESIGNING THE SAME

CROSS REFERENCE TO RELATED APPLICATION

The present application claims priority from Japanese Patent Application No. 2013-004833, which was filed on Jan. 15, 2013, the disclosure of which is herein incorporated by reference in its entirety.

BACKGROUND OF THE INVENTION

1. Field of the Invention

The present invention relates to an electric stringed musical instrument configured to detect vibrations transmitted from a string supported by a body via a bridge and produce an output, and to a method of designing the electric stringed musical instrument.

2. Description of the Related Art

There is conventionally known an electric stringed musical instrument configured to pick up vibrations of strings by means of a pickup sensor to produce a sound of a stringed instrument. For example, Patent Document 1 (Japanese Patent No. 3225856) discloses an electric violin as an electric stringed musical instrument. This violin includes a body for supporting strings via a bridge, and this body is composed of a plurality of layers stacked on one another. Sticky layers are sandwiched between the plurality of layers to reduce a large amount of energy generated by vibrations of the strings and radiated to air as a sound via vibrations of the body, resulting in a smaller or no volume of a sound emitted to air.

Patent Document 2 (Japanese Patent Application Publication No. 60-154299) discloses an electric stringed musical instrument including a member constituted by a stiff base supporter, a bridge suspension, a span, and a bridge crown which are formed integrally with each other. This member is placed on a solid body via a height adjusting mechanism. The bridge crown supports strings, and a pickup constituted by a piezoelectric element is provided between the stiff base supporter and the span. In this electric stringed musical instrument, the bridge suspension has flexibility. Furthermore, this electric stringed musical instrument uses the flexible bridge suspension to transmit energy between vibrations of the strings and the pickup, whereby an instrument sound based on an electric signal obtained by conversion of the pickup is brought closer to a sound of an acoustic stringed musical instrument.

SUMMARY OF THE INVENTION

The electric stringed musical instrument disclosed in Patent Document 1 can sufficiently reduce the volume of the sound as described above, but the body is formed of a material having high stiffness. Thus, vibration energy of the strings remains in the strings for a relatively long time, and the vibrations of the strings decay slowly, leading to discomfort to a player of the common acoustic stringed musical instrument. In addition, while a common acoustic stringed musical instrument causes a main resonance of the body when seen from the bridge to a body-side, this resonance does not occur due to the structure of the body in the case of the electric stringed musical instrument, or if occurs the magnitude of the resonance is very small, and a resonant frequency deviates from that of the common acoustic stringed musical instrument. Accordingly, differences of sound volume with respect to a pitch, a tone quality, and decay characteristics in this conventional electric stringed musical instrument greatly differ from those in the common acoustic stringed musical instrument, so that a playability and an expressive power of the common acoustic stringed musical instrument cannot be obtained.

Furthermore, in the electric stringed musical instrument disclosed in Patent Document 2, the instrument sound based on the electric signal obtained by conversion of the pickup is brought closer to the sound of the acoustic stringed musical instrument as described above, but more concrete efforts are not found to bring the instrument sound closer to the sound of the actual acoustic stringed musical instrument in vibration characteristics such as a resonant frequency and a resonance level.

This invention has been developed in view of the above-described situations, and it is an object of the present invention to provide: an electric stringed musical instrument having no resonance body which is capable of improving a playability and an expressive power of musical performance by bringing an instrument sound of the electric stringed musical instrument closer to that of a common acoustic stringed musical instrument in characteristics of a stringed instrument sound such as differences of a sound volume with respect to a pitch, a tone quality, and a decay of a sound; and a method of designing the electric stringed musical instrument.

The object indicated above may be achieved according to the present invention which provides an electric stringed musical instrument including: a string which vibrates by a performance operation; a body which supports the string via a bridge; a pickup sensor mounted on a portion which vibrates by a vibration of the string, the pickup sensor being configured to detect a vibration having propagated from the string and output an electric signal; a supporter having a spring structure which supports the bridge with respect to the body, and a damper mounted on a portion which vibrates by a vibration of the string, the damper being configured to damp a vibration of the bridge.

The object indicated above may also be achieved according to the present invention which provides a method of designing an electric stringed musical instrument including: a string which vibrates by a performance operation; a body which supports the string via a bridge; a pickup sensor mounted on a portion which vibrates by a vibration of the string, the pickup sensor being configured to detect a vibration having propagated from the string and output an electric signal; a supporter having a spring structure which supports the bridge with respect to the body; and a damper mounted on a portion which vibrates by a vibration of the string, the damper being configured to damp a vibration of the bridge, the method comprising designing a mass of components around the bridge, a spring constant of the supporter, losses due to the bridge and the supporter, a mass of the damper, a spring constant of the damper, and a loss due to the damper such that two peaks appear in vibration characteristics of the electric stringed musical instrument, wherein the two peaks respectively correspond to two peaks appearing in vibration characteristics of an acoustic stringed musical instrument.

In the present invention as described above, the supporter achieves vibration characteristics (i.e., resonance characteristics) of a top board of a common acoustic stringed musical instrument. Also, the damper achieves vibration characteristics (i.e., anti-resonance characteristics) of air around a sound hole and in a body of the common acoustic stringed musical instrument. As a result, even an electric stringed musical instrument having no resonance body and including a body having high stiffness achieves vibration characteristics of the common acoustic stringed musical instrument, i.e., vibration characteristics having two peaks and one dip, whereby characteristics of a sound of the stringed instrument such as differences of sound volume with respect to a pitch, a tone quality, and decay of a sound can be brought closer to those of the common acoustic stringed musical instrument to improve a playability and an expressive power of musical performance.

FORMS OF THE INVENTION

The reference numerals in the brackets attached to respective constituent elements of the device in the following description correspond to reference numerals used in the following embodiments to identify the respective constituent elements. The reference numerals attached to each constituent element indicates a correspondence between each element and its one example, and each element is not limited to the one example.

To achieve the objected described above, the present invention provides an electric stringed musical instrument (1) comprising: a string (14) which vibrates by a performance operation; a body (11) which supports the string via a bridge (12); a pickup sensor (16) mounted on a portion near the bridge, which portion vibrates by a vibration of the string, the pickup sensor being configured to detect a vibration having propagated from the sizing and output an electric signal; a supporter (13; 41, 42; 43; 44; 45) having a spring structure which supports the bridge with respect to the body; and a damper (17, 18; 46, 47) mounted on a portion near the bridge, which portion vibrates by a vibration of the string, the damper being configured to damp a vibration of the bridge.

In this configuration, the damper may be configured such that a mass of the damper is substantially equal to that of air around a sound hole of one acoustic stringed musical instrument, a spring constant of the damper is substantially equal to that of air in a body of the one acoustic stringed musical instrument, and a loss due to the damper is substantially equal to a loss caused by the air around the sound hole of the one acoustic stringed musical instrument.

In this configuration, the supporter (13) is a plate spring whose one end or opposite ends are fixed to the body. Also, the supporter (43) may be an elastic member interposed between the body and the bridge. Also, the supporter (44, 45) may be a thin plate that is formed integrally with the body in a state in which a space is formed between the supporter and the body. Also, the supporter (41, 42) may be a plate having high stiffness and a coil spring, provided on an upper face of the body, for supporting the plate.

Also, the damper (17, 18; 46, 47) is constituted by an elastic member and a weight fixed to the elastic member, for example. Specifically, the damper is preferably constituted by: a plate spring (17) having one end fixed to one of the bridge and the supporter; and a weight (18) fixed to the plate spring.

Also, the pickup sensor (16) is preferably provided on at least one of the bridge (12) and the damper (17, 18; 46, 47), for example.

Also, the damper may be mounted on the supporter and may be mounted on the bridge.

To achieve the objected described above, the present invention also provides a method of designing an electric stringed musical instrument (1) comprising: a string (14) which vibrates by a performance operation; a body (11) which supports the string via a bridge (12); a pickup sensor (16) mounted on a portion which vibrates by a vibration of the string, the pickup sensor being configured to detect a vibration having propagated from the string and output an electric signal; a supporter (13; 41, 42; 43; 44; 45) having a spring structure which supports the bridge with respect to the body; and a damper (17, 18; 46, 47) mounted on a portion which vibrates by a vibration of the string, the damper being configured to damp a vibration of the bridge, the method comprising designing a mass of components around the bridge, a spring constant of the supporter, losses due to the bridge and the supporter, a mass of the damper, a spring constant of the damper, and a loss due to the damper such that two peaks appear in vibration characteristics of the electric stringed musical instrument, wherein the two peaks respectively correspond to two peaks appearing in vibration characteristics of an acoustic stringed musical instrument. The two peaks may respectively correspond to two peaks appearing due to (i) a top board of the acoustic stringed musical instrument and (ii) air around a sound hole of the acoustic stringed musical instrument and in a resonance body of the acoustic stringed musical instrument.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIG. 8 is a side view of the electric guitar when seen from the lower side in FIG. 7);

Figure 1:
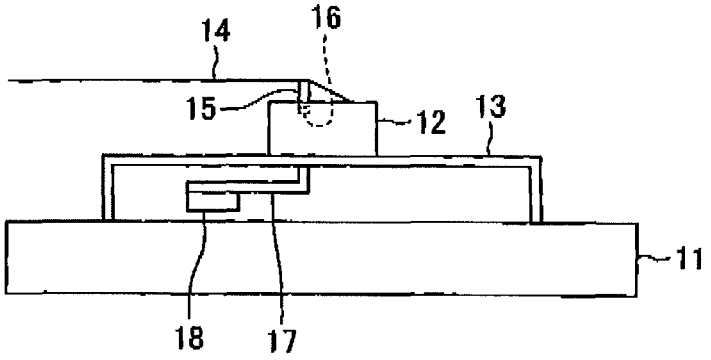
FIG. 1 is a schematic side view illustrating a string support pardon of an electric stringed musical instrument having a basic structure of the present invention.

DETAILED DESCRIPTION OF THE EMBODIMENT a. Example of Basic Structure

First, there will be explained, by way of example, an electric stringed musical instrument having a basic structure of the present invention with reference to FIG. 1.

The electric stringed musical instrument includes a body 11 made of wood and having high stiffness. Mounted on the body 11 is a bridge supporter 13 for supporting a bridge 12 by means of its spring structure. The bridge supporter 13 is an elastic metal plate, specifically, a plate spring elongated in a direction in which strings 14 extend. Opposite end portions of the bridge supporter 13 are bent generally perpendicularly so as to extend in the same direction (the down direction in FIG. 1). The bridge supporter 13 is fixed at its opposite ends to the body 11. The bridge 12 is an elongated member extending in a direction perpendicular to the direction in which the strings 14 extend. The bridge 12 is formed of a material such as wood and resin and fixed to the bridge supporter 13. Fixed on the bridge 12 is a saddle 15 which is made of a material such as resin and ivory. An upper end portion of the saddle 15 supports the strings 14 which are fastened at one ends to the bridge 12.

A pickup sensor 16 is mounted between the saddle 15 and the bridge 12. The pickup sensor 16 is designed to pick up or detect vibrations from the strings 14 to output an electric signal based on the vibrations. The pickup sensor 16 is constituted by a piezoelectric sensor, for example. A lower face of the bridge supporter 13 is provided with a damper that is located on an upper side of the body 11. The damper is constituted by a plate spring 17 and a weight 18. The plate spring 17 is an elastic metal plate elongated in the direction in which the strings 14 extend. One end portion of the plate spring 17 is bent generally perpendicularly (so as to extend in the up direction in FIG. 1), and the plate spring 17 is fixed at the one end portion to the lower face of the bridge supporter 13. The weight 18 is fixed to the other end portion of the plate spring 17. While the weight 18 is fixed to a lower face of the plate spring 17 in this example of the basic structure, the weight 18 may be fixed to an upper face of the plate spring 17. The damper having this structure damps vibrations of a predetermined frequency or frequencies.

In the electric stringed musical instrument having the above-described structure, the mass of components around the bridge 12 is adjusted generally to the mass of components around a bridge of an acoustic stringed musical instrument (as one example of one acoustic stringed musical instrument) having a tone color which the electric stringed musical instrument attempts to mimic or produce, that is, the mass of components around the bridge 12 is adjusted generally to the mass of the bridge and components around a portion of the top board on which the bridge is mounted. Also, spring characteristics (i.e., a spring constant) of the bridge supporter 13 are adjusted generally to spring characteristics of the portion of the top board around the bridge of the acoustic stringed musical instrument having a tone color which the electric stringed musical instrument attempts to mimic. A loss due to the bridge 12 and a loss due to the bridge supporter 13 are respectively given appropriate constants and thereby adjusted generally to a loss due to a structure of components around the bridge of the acoustic stringed musical instrument having a tone color which the electric stringed musical instrument attempts to mimic. It is noted that each of the losses and a loss described in the following explanation means an amount of energy that is lost from a vibrating system by its conversion to thermal energy due to friction caused by movement of a material such as components and particles of air and/or by its conversion to sound energy due to acoustic radiation. Spring characteristics, the mass, and a loss due to the damper constituted by the plate spring 17 and the weight 18 are respectively adjusted generally to spring characteristics of air in the body, the mass of air around a sound hole, and a loss due to the air in the acoustic stringed musical instrument having a tone color which the electric stringed musical instrument attempts to mimic. As a result, adding the damper to the electric stringed musical instrument having no resonance body can bring vibration characteristics of the electric stringed musical instrument having no resonance body close to those of the acoustic stringed musical instrument having a resonance body as will be described later.

As a result, in the electric stringed musical instrument having the above-described structure, vibration characteristics of the electric stringed musical instrument vibrated by the strings 14 being vibrated are made substantially equal to those of the acoustic stringed musical instrument having a tone color which the electric stringed musical instrument attempts to mimic. Also, propagation of energy between the bridge 12 and the strings 14 being vibrated by a musical performance is made substantially equal to that of the acoustic stringed musical instrument having a tone color which the electric stringed musical instrument attempts to mimic. As a result, a sound volume with respect to a pitch, a tone quality, and decay characteristics of the electric stringed musical instrument are made substantially equal to those of the acoustic stringed musical instrument having a tone color which the electric stringed musical instrument attempts to mimic. These characteristics appear in an instrument sound based on the electric signal obtained by conversion of the pickup sensor 16, allowing the stringed instrument having no resonance body to obtain an expressive power and a playability of an instrument having the resonance body. It is noted that these characteristics appear in a sound that can be heard directly through air though its volume is small because of the stringed instrument having no resonance body.

Figure 2A:
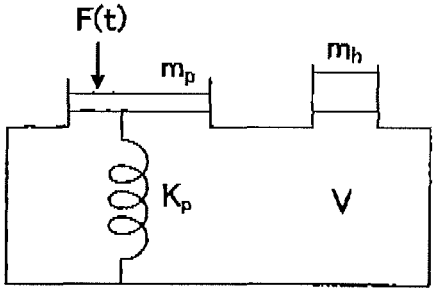
FIG. 2A is a view illustrating a two-mass model representing motion of a common acoustic guitar including a solid back board and a solid side face.

Here, there will be explained, using a mass model and equivalent electric circuits, settings for the mass of the components around the bridge 12, the spring characteristics of the bridge supporter 13, the losses due to the bridge 12 and the bridge supporter 13, the spring characteristics of the damper constituted by the plate spring 17 and the weight 18, the mass of the damper, and the loss due to the damper. FIG. 2A illustrates a two-mass model representing motion of a common acoustic guitar including a solid back board and a solid side face (i.e., an acoustic guitar having a resonance body). In FIG. 2A, F(t) represents the magnitude of a driving force acting on the top board, $m_p$ represents the mass of the top board, Kp represents the spring constant of the top board, $m_h$ represents the mass of air around the sound hole, and V represents the volume of the body.

Figure 2B:
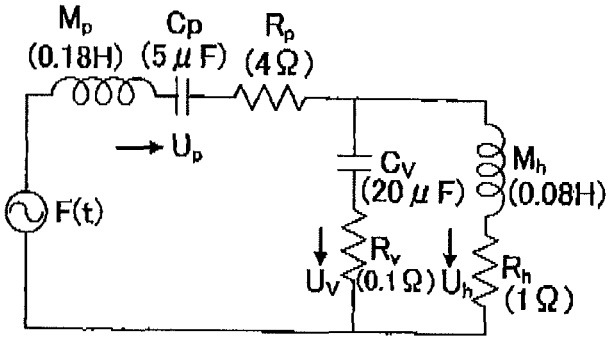
FIG. 2B is a view illustrating an equivalent electric circuit that represents the two-mass model.

FIG. 2B illustrates an equivalent electric circuit representative of the two-mass model in FIG. 2A. In FIG. 2B, F(t) represents an amplitude of voltage of an alternating-current power supply. Mp represents the inductance of a coil which corresponds to the mass $m_p$ of the top board, Cp represents the capacitance of a capacitor which corresponds to a spring compliance that is the inverse of the spring constant Kp of the top board, and Rp represents the magnitude of resistance which corresponds to a loss due to the top board. The inductance Mp, the capacitance Cp, and the magnitude of resistance Rp are elements relating to the top board and are, for example, 0.18 H, 5 μF, and 4Ω, respectively. Mh represents the inductance of a coil which corresponds to the mass $m_h$ of air around the sound hole, Rh represents the magnitude of resistance which corresponds to a loss due to the air around the sound hole, Cv represents the capacitance of a capacitor which corresponds to a spring compliance that is the inverse of the spring constant of air in the body, and Rv represents the magnitude of resistance which corresponds to a loss due to the air in the body. The inductance Mh, the magnitude of resistance Rh, the capacitance Cv, and the magnitude of resistance Rv are elements relating to air and are, for example, 0.08 H, 1Ω, 20 μF, and 0.1Ω, respectively. Each of Up, Uh, and Uv represents a current corresponding to a velocity.

Figure 3A:
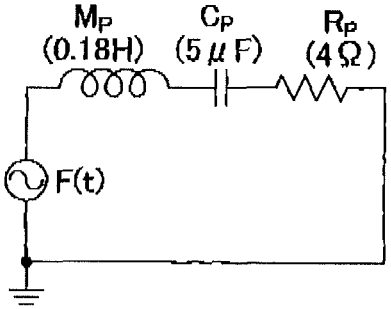
FIG. 3A is a view illustrating an equivalent electric circuit that represents only elements relating to a top board by excluding elements relating to air from the equivalent electric circuit illustrated in FIG. 2B.
Figure 3B:
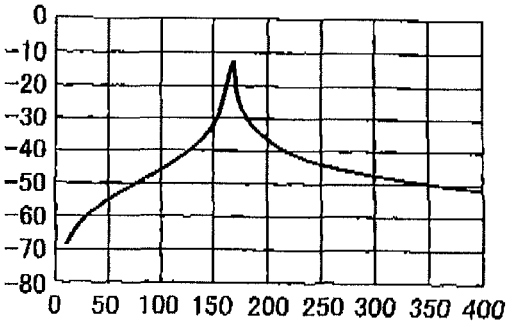
FIG. 3B is a graph illustrating a frequency response of the equivalent electric circuit illustrated in FIG. 3A.
Figure 4A:
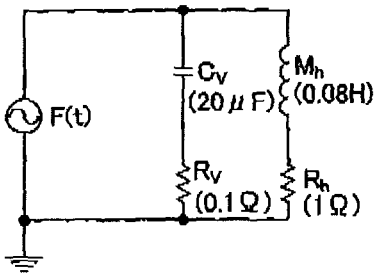
FIG. 4A is a view illustrating an equivalent electric circuit that represents only the elements relating to air by excluding the elements relating to the top board from the equivalent electric circuit illustrated in FIG. 2B.
Figure 4B:
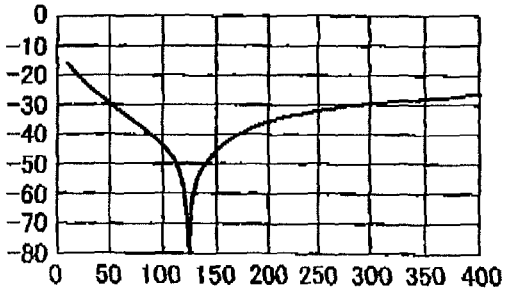
FIG. 4B is a graph illustrating a frequency response of the equivalent electric circuit illustrated in FIG. 4A.

FIG. 3A illustrates an equivalent electric circuit that represents only the elements Mp, Cp, and Rp relating to the top board by excluding the elements Mh, Rh, Cv, and Rv relating to air FIG. 3B illustrates a frequency response of this equivalent electric circuit. FIG. 3B indicates that the top board causes a large peak of resonance which appears around 170 Hz in the electric stringed musical instrument having no resonance body. On the other hand, FIG. 4A illustrates an equivalent electric circuit that represents only the elements Mh, Rh, Cv, and Rv relating to air by excluding the elements Mp, Cp, and Rp relating to the top board. FIG. 4B illustrates a frequency response of this equivalent electric circuit. FIG. 4B indicates that, in the acoustic guitar having a resonance body, the air around the sound hole and in the body causes a large anti-resonance (i.e., the Helmholtz resonance) whose dip appears around 125 Hz in the vibration characteristics of the acoustic guitar having a resonance body. Combining the equivalent electric circuits in FIG. 3A and FIG. 4A forms an equivalent electric circuit illustrated in FIG. 5A (which is identical to that in FIG. 2B). FIG. 5B illustrates a frequency response of this equivalent electric circuit. FIG. 5B indicates that the vibration frequency response of the acoustic guitar having a resonance body has: two peaks of resonance which appear around 110 Hz and around 200 Hz; and a dip of anti-resonance which appears around 125 Hz.

Figure 5A:
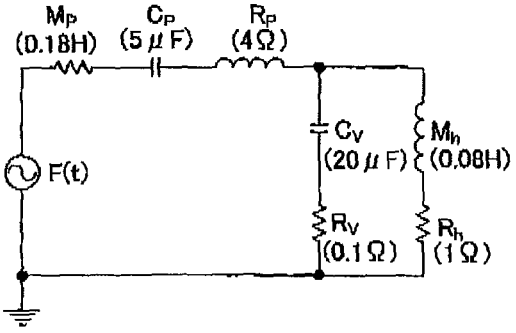
FIG. 5A is a view illustrating an equivalent electric circuit obtained by combining the equivalent electric circuit in FIG. 3A and the equivalent electric circuit in FIG. 4A.
Figure 5B:
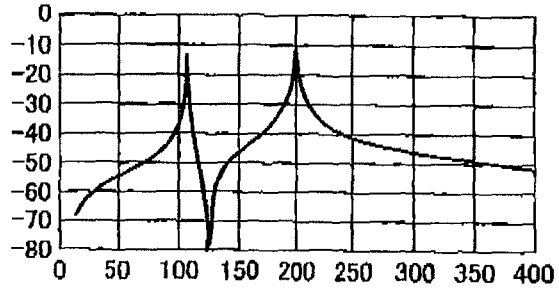
FIG. 5B is a graph illustrating a frequency response of the equivalent electric circuit illustrated in FIG. 5A.
Figure 6:
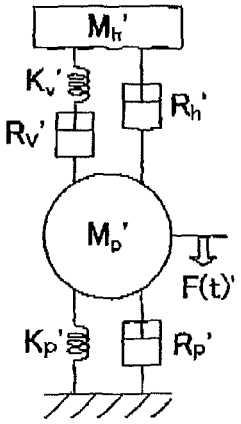
FIG. 6 is a view illustrating a vibration model of the equivalent electric circuit in FIG. 5A which is expressed by regarding the circuit as only purely mechanical elements.
Figure 7:
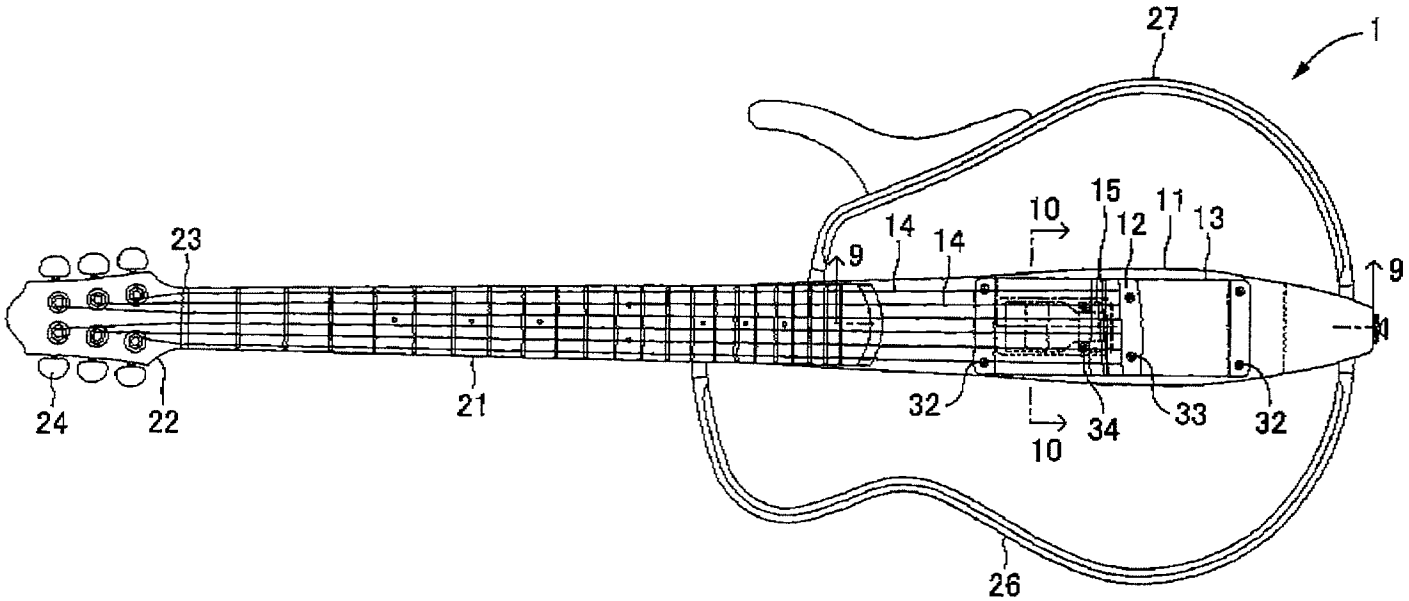
FIG. 7 is a top view of an electric guitar according to one embodiment of the present invention.
Figure 8:
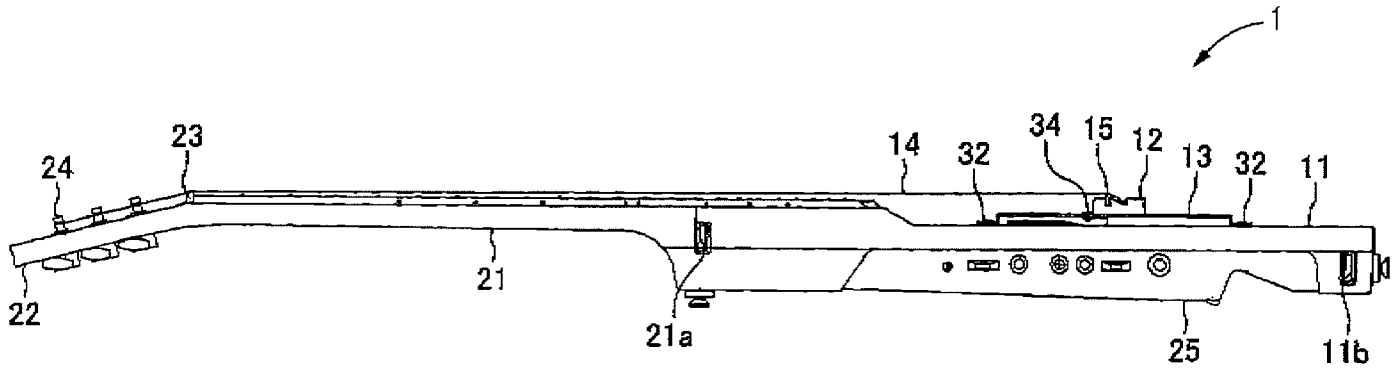
FIG. 8 is a side view of the electric guitar in a state in which a body frame is removed from the electric guitar illustrated in FIG. 7 (in other words.
Figure 9:
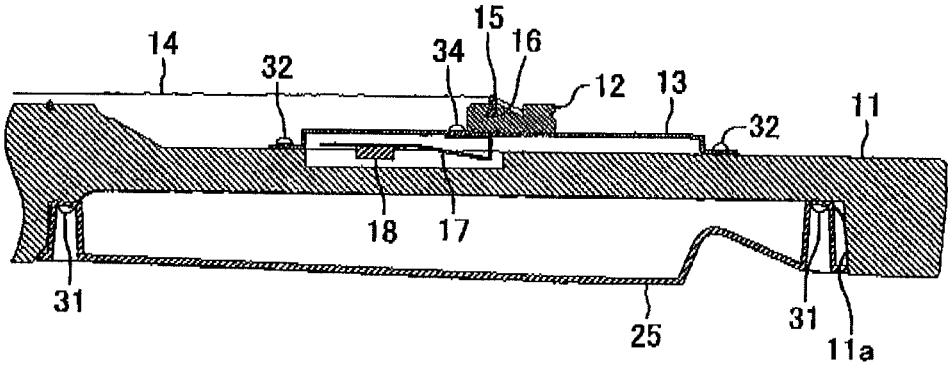
FIG. 9 is a partly enlarged cross-sectional view of the electric guitar taken along line 9-9 in FIG. 7.
Figure 10:
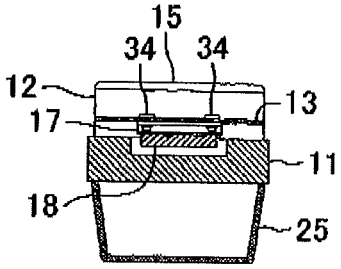
FIG. 10 is a partly enlarged cross-sectional view of the electric guitar taken along line 10-10 in FIG. 7.

Next, assuming a vibration model that is constituted by only purely mechanical elements corresponding to the equivalent electric circuit illustrated in FIG. 5A, this vibration model is represented in FIG. 6. This vibration model corresponds to a strings-support portion of the electric stringed musical instrument illustrated in FIG. 1. In FIG. 6, Mp' corresponds to the mass of the bridge supporter (the plate spring) 13 and the bridge 12, Kp' to the spring constant of the bridge supporter 13, Rp' to the loss due to the bridge supporter 13, and F(t)' to an exciting force applied by the strings. As a result, the vibration characteristics (i.e., resonance characteristics) of the top board of the acoustic stringed musical instrument (the acoustic guitar) having a resonance body can be simulated by the bridge supporter 13. Also, Mh' corresponds to the mass of the plate spring 17 and the weight 18 constituting the damper, Kv' to the spring constant of the plate spring 17, Rv' to the loss due to the plate spring 17, and Rh' to the loss due to the weight 18. As a result, the vibration characteristics (i.e., anti-resonance characteristics) of the air around the sound hole and in the body of the common acoustic stringed musical instrument (the acoustic guitar) can be simulated by the damper constituted by the plate spring 17 and the weight 18.

In these simulations, the elements of the bridge supporter 13 and the plate spring 17 such as the mass, the spring constant, and the magnitude, and the masses of the bridge 12 and the weight 18 are appropriately set in accordance with characteristics of the desired acoustic stringed musical instrument. As a result, even the electric stringed musical instrument including the body 11 having high stiffness and not including the resonance body can achieve the vibration characteristics of the acoustic stringed musical instrument by means of the bridge supporter 13 having the spring structure and the damper constituted by the plate spring 17 and the weight 18, i.e., by means of the basic structure illustrated in FIG. 1. In other words, the electric stringed musical instrument having no resonance body is provided with the bridge supporter and the damper, and the mass of components around the bridge of the electric stringed musical instrument, the spring constant of the bridge supporter, losses due to the bridge and the bridge supporter, the mass of the damper, the spring constant of the damper, and the loss due to the damper are designed such that two peaks appear in the vibration characteristics of the electric stringed musical instrument having no resonance body, whereby the vibration characteristics of the electric stringed musical instrument having no resonance body can get closer to those of the acoustic stringed musical instrument having the resonance body.

b. One Embodiment

There will be next explained, with reference to FIGS. 7-10, one embodiment of the electric stringed musical instrument having the basic structure illustrated in FIG. 1, taking an electric guitar 1 as an example.

The electric guitar 1 includes the body 11 and a neck 21 and includes the plurality of strings 14 tensioned between: the bridge 12 and the bridge supporter 13 fixed on the top of the body 11; and a head 22 provided at an end portion of the neck 21. The body 11 is a thick wood member elongated so as to have generally a rectangular shape as seen from an upper side thereof. The body 11 also has such high stiffness that does not cause acoustic vibrations. The neck 21 is formed integrally with the body 11 so as to extend and has a fingerboard on an upper face thereof. The head 22 is formed integrally with the neck 21. The plurality of strings 14 are supported at their opposite end portions by the saddle 15 fixed to the bridge 12 and a nut 23 provided on the end portion of the neck 21, respectively, and opposite ends of the strings 14 are fastened to the bridge 12 and pegs 24, respectively.

A lower face of the body 11 has a recessed portion 11*a*, and a thin cover 25 is secured to the lower face of the body 11 by screws 31, so that a space is formed in the cover 25. Electric circuits, not shown, are provided in this space, and components provided on an outer face of the cover 25 include connection terminals for the electric circuits and elements for operating the electric circuits. Body frames 26, 27 are respectively provided on opposite sides of the body 11 and the neck 21. Each of the body frames 26, 27 is formed like a thin curved plate formed of a material such as metal, resin, and wood. Opposite ends of the body frames 26, 27 are respectively fitted in holes 11*b*, 21*a* formed in side faces of the body 11 and the neck 21, whereby the body frames 26, 27 are mounted on the body 11 and the neck 21, respectively.

Figure 11:
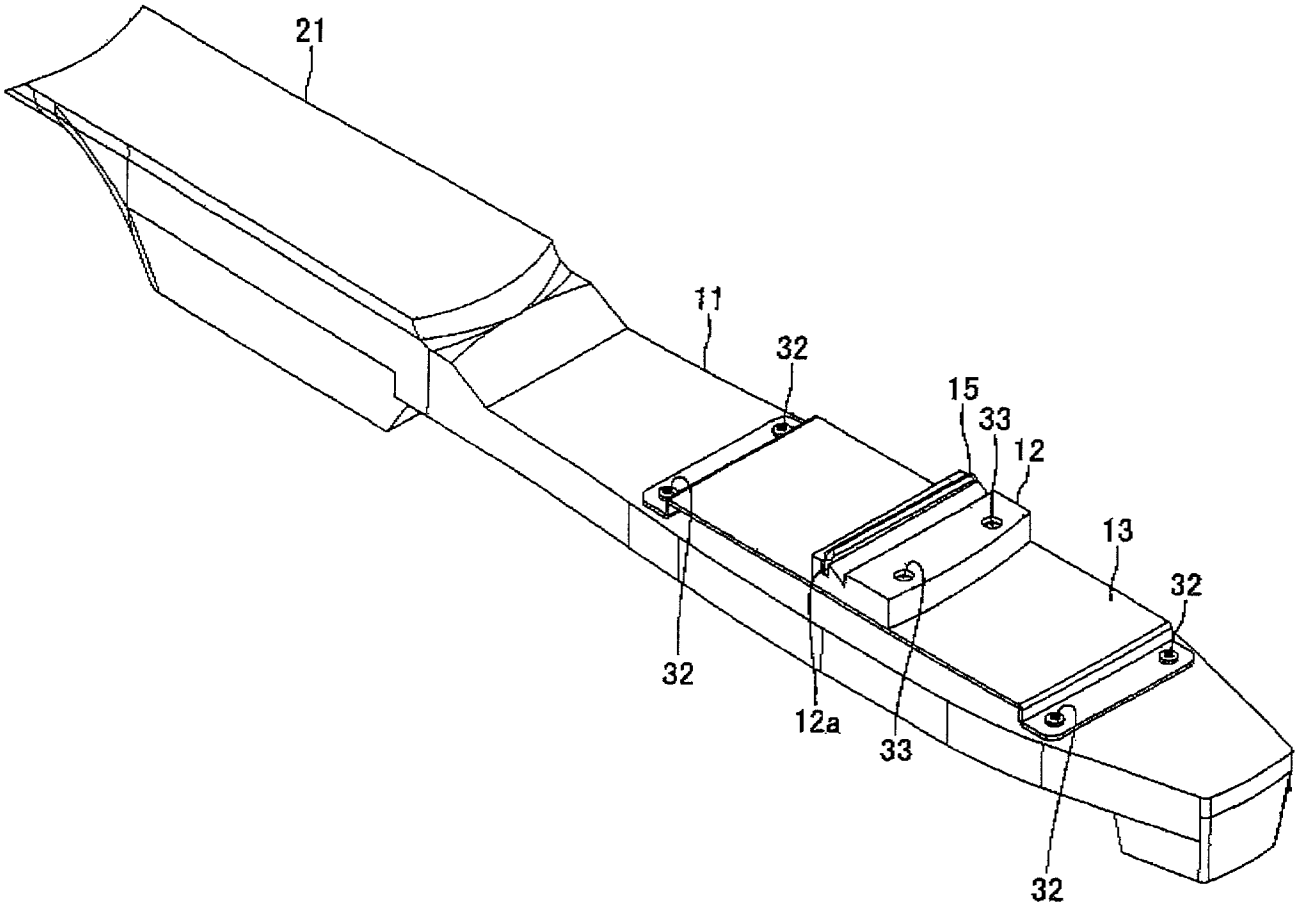
FIG. 11 is an enlarged perspective view of a body of the electric guitar illustrated in FIGS. 7 and 8.
Figure 12:
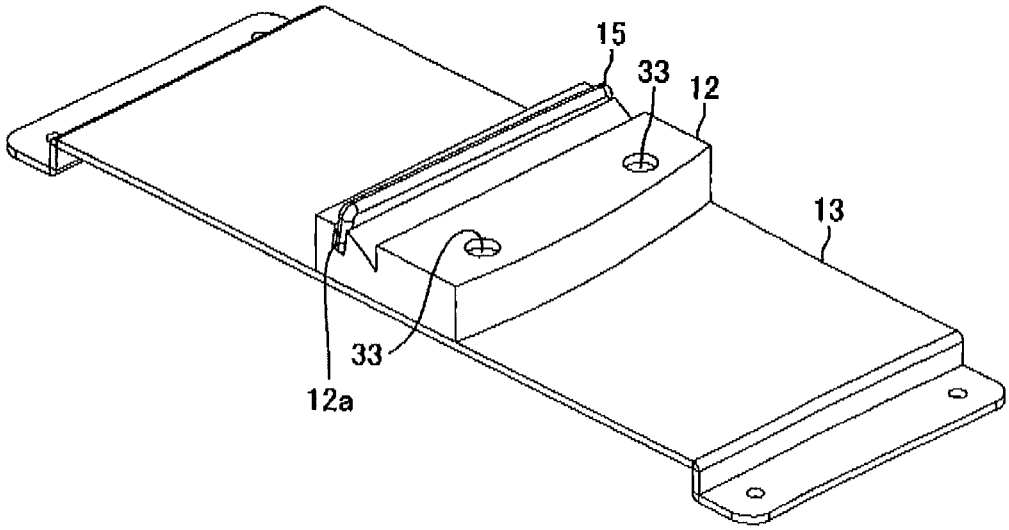
FIG. 12 is an enlarged perspective view illustrating a bridge supporter illustrated in FIGS. 7 and 8 in a state in which the bridge supporter is separated from the body.

There will be next explained the bridge supporter 13 in detail with reference to FIGS. 11 and 12. The bridge supporter 13 is constituted by a metal plate spring whose opposite end portions in its longitudinal direction are bent like a hook (so as to have an L shape), and the bridge supporter 13 is secured at is opposite end portions to an upper face of the body 11 by screws 32. The bridge 12 formed of wood or resin is fixed by screws 33 to an upper face of a central portion of the bridge supporter 13 in its longitudinal direction. An upper face of the bridge 12 has a square slit 12*a* in which the saddle 15 formed of, e.g., resin or ivory is fitted and fixed. The pickup sensor 16 (see FIG. 9) constituted by a piezoelectric element is disposed between the bridge 12 and a bottom face of the slit 12*a*, i.e., the saddle 15. The pickup sensor 16 detects or picks up vibrations transmitted through the saddle 15 and the bridge 12, converts them to an electric signal, and output it to the electric circuits (i.e., an electric circuit device).

Figure 13:
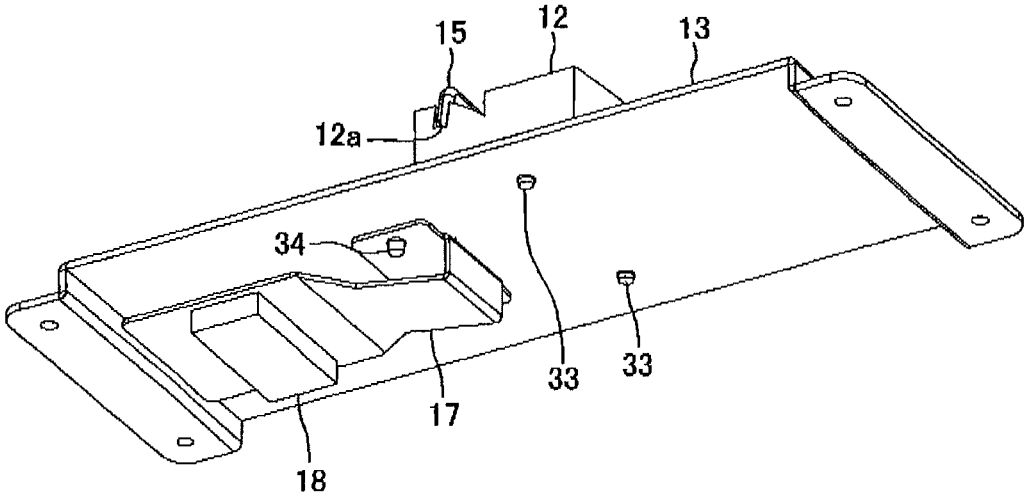
FIG. 13 is an enlarged perspective view illustrating the bridge supporter illustrated in FIGS. 7 and 8 when seen from the lower side thereof in the state in which the bridge supporter is separated from the body.

As illustrated in FIG. 13, the damper constituted by the metal plate spring 17 and the weight 18 is mounted on the lower face of the bridge supporter 13. One end portion of the plate spring 17 is bent like a U-shape whose bent portion is secured to the bridge supporter 13 by screws 34. The weight 18 is fixed to the lower face of the plate spring 17. It is noted that the weight 18 may be fixed to an upper face of the plate spring 17.

As in the example of the basic structure, the electric guitar 1 according to the one embodiment having the above-described structure can also achieve the vibration characteristics (i.e., the resonance characteristics) of the top board (the bridge) of the acoustic guitar having a resonance body by means of the bridge supporter 13. Also, the damper constituted by the plate spring 17 and the weight 18 achieves the vibration characteristics (i.e., the anti-resonance characteristics) of the air around the sound hole and in the body of the acoustic guitar. As a result, also in this electric guitar 1 according to the one embodiment, as described above, the sound volume with respect to a pitch, the tone quality, and the decay characteristics are made substantially equal to those of the acoustic guitar. Since these characteristics appear in an instrument sound based on the electric signal converted by the pickup sensor 16, the electric guitar having no resonance body can also obtain an expressive power and a playability of the acoustic guitar having a resonance body.

c. Modifications

While the example of the basic structure and the one embodiment have been described above, it is to be understood that the invention is not limited to the details of the example of the basic structure and the one embodiment, but may be embodied with various changes and modifications, which may occur to those skilled in the art, without departing from the spirit and scope of the invention.

While an example of application of the basic structure according to the present invention to the electric guitar 1 is explained in the above-described one embodiment, the basic structure is applicable to electric stringed musical instruments other than the electric guitar 1.

Figure 14:
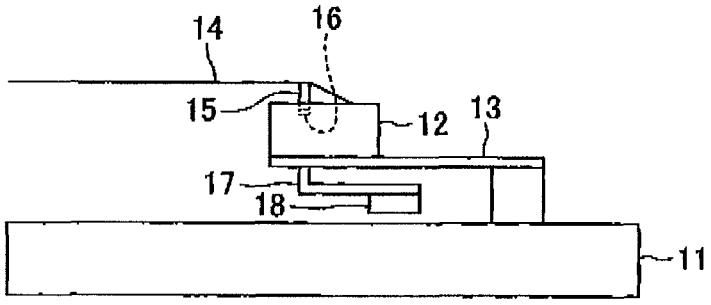
FIG. 14 is a schematic side view illustrating a strings-support portion of an electric stringed musical instrument according to a modification.

In the example of the basic structure and the one embodiment described above, the opposite end portions of the bridge supporter 13 for supporting the bridge 12 are fixed to the body 11. Instead of this structure, as illustrated in FIG. 14, only one end of the bridge supporter 13 may be fixed to the body 11, that is the bridge supporter 13 may have a cantilever structure with respect to the body 11. This structure also allows vibrations of the bridge supporter 13, leading to the same effects as in the example of the basic structure and the one embodiment described above.

Figure 15:
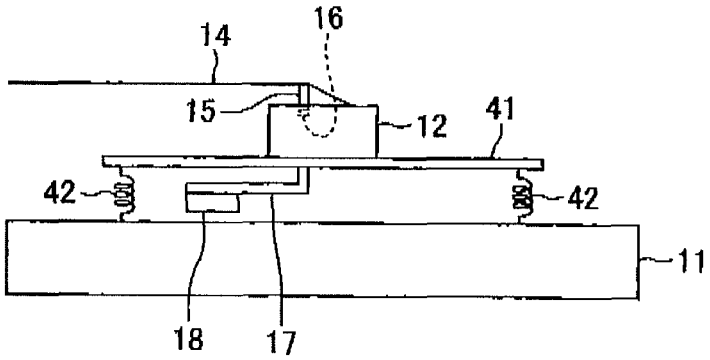
FIG. 15 is a schematic side view illustrating a strings-support portion of an electric stringed musical instrument according to another modification.

In the example of the basic structure and the one embodiment described above, the bridge supporter 13 for supporting the bridge 12 is constituted by a plate spring. Instead of this structure, as illustrated in FIG. 15, the bridge supporter may be constituted by a plate 41 having high stiffness and a plurality of coil springs 42 fixed to a lower face of the plate 41 for supporting the plate 41. That is, the electric stringed musical instrument may be configured such that lower ends of the plurality of coil springs 42 are fixed to the body 11, upper ends of the plurality of coil springs 42 are fixed to a lower face of the plate 41, and the bridge 12 is fixed to an upper face of the plate 41. This structure also allows the plate 41 to be vibrated by the coil springs 42, leading to the same effects as in the example of the basic structure and the one embodiment described above.

Figure 16:
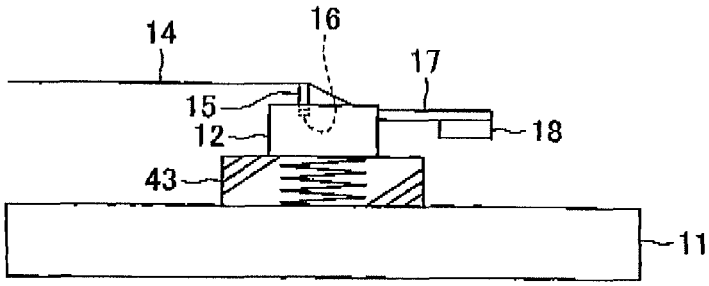
FIG. 16 is a schematic side view illustrating a strings-support portion of an electric stringed musical instrument according to another modification.

Instead of the bridge supporter 13 constituted by the plate spring in the example of the basic structure and the one embodiment described above, as illustrated in FIG. 16, a bridge supporter 43 as an elastic member formed of an elastic material such as rubber and resin may be sandwiched between the body 11 and the bridge 12. That is, the electric stringed musical instrument may be configured such that the bridge supporter 43 as the elastic member is fixed to the upper face of the body 11, and the bridge 12 is fixed to the bridge supporter 43. In this case, the damper constituted by the plate spring 17 and the weight 18 can be mounted on the bridge supporter 43 but is preferably mounted on the bridge 12 because the bridge supporter 43 is deformable. Also in this structure, the bridge 12 is supported by the body 11 via the bridge supporter 43 as the elastic member in a state in which the bridge 12 can vibrate, leading to the same effects as in the example of the basic structure and the one embodiment described above. It is noted that the structure of mounting the damper constituted by the plate spring 17 and the weight 18 on the bridge 12 is applicable to the example of the basic structure, the one embodiment, and the modifications described above.

Figure 17A:
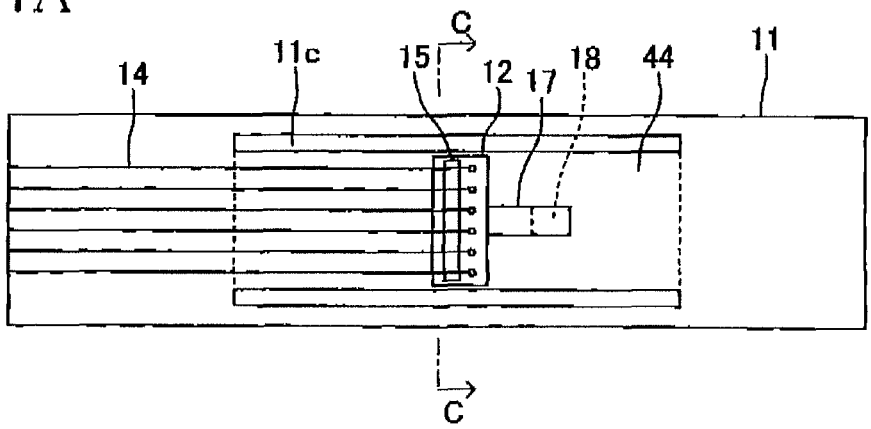
FIG. 17A is a schematic top view illustrating a strings-support portion of an electric stringed musical instrument according to another modification.
Figure 17B:
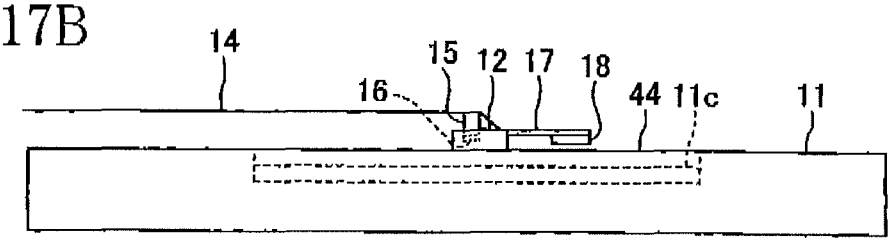
FIG. 17B is a schematic side view of FIG. 17A.
Figure 17C:
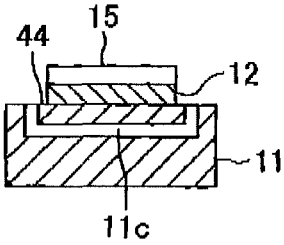
FIG. 17C is a schematic cross-sectional view taken along line C-C in FIG. 17A.

Instead of the bridge supporter 13 constituted by the plate spring in the example of the basic structure and the one embodiment described above, a structure illustrated in FIGS. 17A-17C may be employed for supporting the bridge 12. That is, a square slit (a space) 11*c* is formed in the wooden body 11 under the bridge 12 so as to extend in the direction in which the strings 14 extend, and opposite ends of the slit 11*c* in the direction perpendicular to the direction in which the strings 14 extend are open in the top of the body 11. The body 11 located on an upper side of the slit 11*c* is formed to have a thin thickness so as to allow vibrations of the body 11 in an up and down direction. In other words, this thin portion of the body 11 serves as a bridge supporter 44 that is an alternative to the bridge supporter 13 constituted by the plate spring in the example of the basic structure and the one embodiment described above, and the bridge 12 is supported by the spring structure of the bridge supporter 44 so as to be vibrated. Also in this case, the damper constituted by the plate spring 17 and the weight 18 is mounted on the bridge 12 but may be mounted on an upper face or a lower face of the bridge supporter 44. Also in this structure, the bridge 12 is supported by the body 11 via the bridge supporter 44 as the elastic member in a state in which the bridge 12 can be vibrated, leading to the same effects as in the example of the basic structure and the one embodiment described above.

Figure 18A:
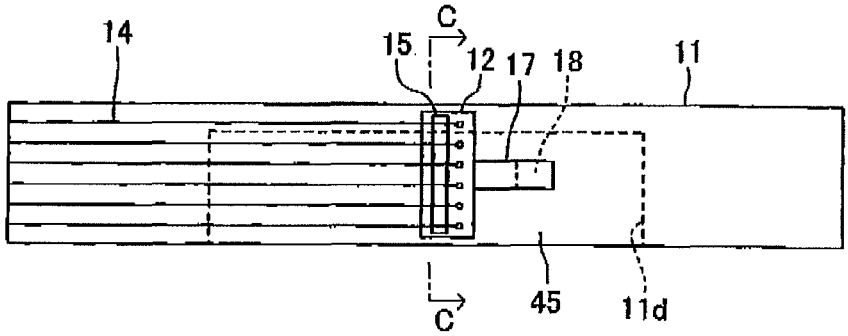
FIG. 18A is a schematic top view illustrating a strings-support portion of an electric stringed musical instrument as a modification of the electric stringed musical instrument illustrated in FIG. 17.
Figure 18B:
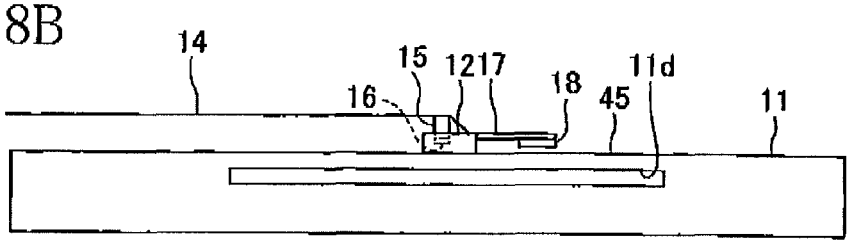
FIG. 18B is a schematic side view of FIG. 18A.
Figure 18C:
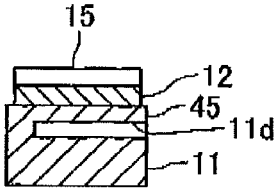
FIG. 18C is a schematic cross-sectional view taken along line C-C in FIG. 18A.

As a modification of the electric stringed musical instrument illustrated in FIG. 17, as illustrated in FIGS. 18A-18C, a slit 11*d* opening in a side face of the body 11 may be formed instead of the slit 11*c* in FIG. 17. That is, a square slit (a space) 11*d* is formed in the wooden body 11 under the bridge 12 so as to extend in the direction in which the strings 14 extend, and one of opposite ends of the slit 11*d* in the direction perpendicular to the direction in which the strings 14 extend is open in the side face of the body 11. Alternatively, both of the opposite ends of the slit 11*d* in the direction perpendicular to the direction in which the strings 14 extend may be open in side faces of the body 11. Also in this structure, the body 11 located on an upper side of the slit 11*d* is formed to have a thin thickness so as to allow vibrations of the body 11 in the up and down direction, and the portion of the body 11 serves as a bridge supporter 45 that is an alternative to the bridge supporter 13 constituted by the plate spring in the example of the basic structure and the one embodiment described above. This structure also allows the bridge 12 to be supported by the spring structure of the bridge supporter 45 in the state in which the bridge 12 can be vibrated, leading to the same effects as in the example of the basic structure and the one embodiment described above. Also in this case, the damper constituted by the plate spring 17 and the weight 18 is mounted on the bridge 12 but may be mounted on an upper face or a lower face of the bridge supporter 45.

Figure 19:
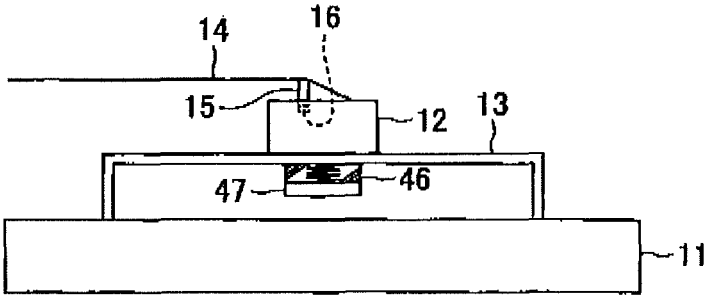
FIG. 19 is a schematic side view illustrating a strings-support portion of an electric stringed musical instrument according to another modification.

In the example of the basic structure and the one embodiment described above, the damper is constituted by the plate spring 17 and the weight 18. Instead of this structure, as illustrated in FIG. 19, the damper may be constituted by a weight 47 and an elastic member 46 formed of an elastic material such as rubber and resin. That is, the electric stringed musical instrument may be configured such that the weight 47 is fixed to a lower face of the elastic member 46, and this elastic member 46 is fixed to the lower face of the bridge supporter 13. This structure also allows the weight 47 to be supported on the bridge supporter 13 by the elastic member 46 in a state in which the weight 47 can be vibrated, leading to the same effects as in the example of the basic structure and the one embodiment described above. It is noted that the damper constituted by the elastic member 46 and the weight 47 is applicable to the above-described modifications. Any damper may be used as long as the damper may achieve the same effects as in the example of the basic structure and the one embodiment described above.

Figure 20:
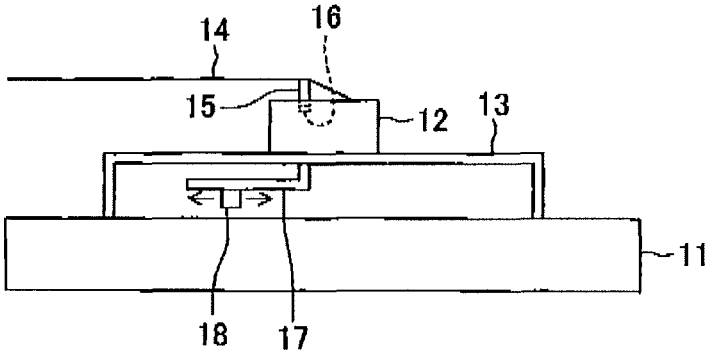
FIG. 20 is a schematic side view illustrating a strings-support portion of an electric stringed musical instrument according to another modification.

In the example of the basic structure and the one embodiment described above, the weight 18 is fixed to the plate spring 17 in the damper. Instead of this structure, as illustrated in FIG. 20, the electric stringed musical instrument may be configured such that the weight 18 is mounted on the plate spring 17 such that a position of the weight 18 with respect to the plate spring 17 can be changed, and the position of the weight 18 is changed as needed. This structure can change the resonant frequency, the magnitude of the resonance, and the like and thereby can mimic the vibration characteristics (i.e., the resonance characteristics) of the sound board of the acoustic stringed musical instrument such as a guitar, a violin, a cello, and a koto and the vibration characteristics (i.e., the anti-resonance characteristics) of the air around the sound hole and in the body, allowing a player to enjoy playing various acoustic stringed musical instruments with one kind of electric stringed musical instrument. For example, by changing the above-described vibration characteristics in which resonance occurs around 200 Hz to vibration characteristics in which resonance occurs around 260 Hz, it is possible to produce a stringed instrument sound like a sound produced by a ukulele. It is noted that the structure allowing the change of the position of the weight 18 with respect to the plate spring 17 is also applicable to the above-described modifications.

Figure 21:
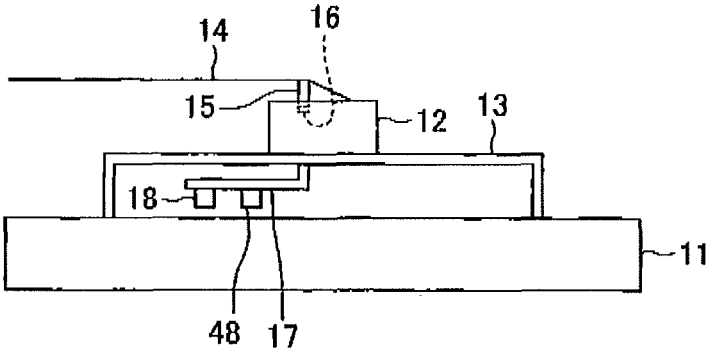
FIG. 21 is a schematic side view illustrating a strings-support portion of an electric stringed musical instrument according to another modification.

While the one weight 18 is fixed to the plate spring 17 in the damper in the example of the basic structure and the one embodiment described above, as illustrated in FIG. 21, two weights, namely, the weight 18 and a weight 48, may be fixed to the plate spring 17, and equal to or more than three weights may be fixed to the plate spring 17. Also, two or more dampers may be fixed to positions near the bridge supporter 13 or the bridge 12. In this structure, the number of points of anti-resonance (dips) in the vibration characteristics increases in accordance with the number of dampers and the number of weights fixed to the dampers, making it possible to attain vibration characteristics having equal to or more than three points of resonance (peaks). It is noted that the structure in which two or more weights are fixed to the plate spring 17 and the structure in which two or more dampers are fixed at positions near the bridge supporter 13 or the bridge 12 are applicable to the above-described modifications.

The pickup sensor 16 is provided on the lower face of the saddle 15, i.e., the bridge 12 in the example of the basic structure, the one embodiment, and the above-described modifications described above, but the present invention is not limited to this structure. That is, the pickup sensor 16 may be provided at any position near the bridge 12 as long as the pickup sensor 16 can detect vibrations of the bridge 12 which are caused by vibrations of the strings 14. For example, the pickup sensor 16 may be provided on an outer circumferential surface of the bridge 12, the bridge supporter 13, or the damper. A plurality of pickup sensors may be provided at different positions to use outputs of the sensors in combination. In particular, in a case where an output of the pickup sensor 16 provided on the bridge 12 and an output of the pickup sensor provided on the damper are used in combination, it is possible to produce a sound having a tone color close to that of the acoustic stringed musical instrument which the electric stringed musical instrument attempts to mimic. This is because the pickup sensor 16 provided on the bridge 12 mainly detects an instrument sound produced by the top board of the acoustic stringed musical instrument, and the pickup sensor provided on the damper mainly detects an instrument sound produced by the sound hole of the acoustic stringed musical instrument.

A piezoelectric element is used as the pickup sensor 16 in the example of the basic structure, the one embodiment, and the modifications described above. However, any sensor may be used as the pickup sensor 16 as long as the sensor can detect vibrations around the bridge 12 (e.g., a displacement, a velocity, and acceleration). Thus, any vibration sensor other than the piezoelectric element can be used as the pickup sensor. For example, sensors such as a semiconductor vibration sensor and a capacitive vibration sensor can be used.

Though not explained in the example of the basic structure and the one embodiment described above, circuits such as an equalizing circuit and a convolving circuit are preferably provided in the electric circuit device to process electric signals produced by the pickup sensor 16 as needed and output the processed signals. This configuration can adjust not only a difference of sound volume due to tone quality and audio range but also a speed of decay of an output signal relating to a speed of decay of the strings 14.

What is claimed is:

1. An electric stringed musical instrument comprising:

a bridge;

a body for supporting a string via the bridge;

a pickup sensor for detecting a vibration which has propagated from the string and outputting an electric signal as a function thereof;

a supporter having a spring structure which supports the bridge with respect to the body; and a damper for damping a vibration of the bridge, the damper being constituted by an elastic member and a weight fixed to the elastic member, the damper being spaced apart from the string such that the damper does not contact the string, the damper being directly mounted on at least one of the supporter and the bridge.

2. The electric stringed musical instrument according to claim 1, wherein the supporter is constituted by an elastic member interposed between the body and the bridge.

3. The electric stringed musical instrument according to claim 1, wherein the supporter is constituted by a thin plate that is coupled to the body such that a space is formed between portions of the supporter and the body.

4. The electric stringed musical instrument according to claim 1, wherein the pickup sensor is provided on at least one of the bridge and the damper.

5. The electric stringed musical instrument according to claim 1, wherein the damper is mounted on the supporter.

6. The electric stringed musical instrument according to claim 1, wherein the damper is mounted on the bridge.

7. The electric stringed musical instrument according to claim 1, wherein the supporter is formed of a plate spring.

8. The electric stringed musical instrument according to claim 7, wherein the plate spring is coupled to the body by at least one spring.

9. The electric stringed musical instrument according to claim 7, wherein the plate spring is bent into a U-shape.

10. The electric stringed musical instrument according to claim 9, wherein the plate spring has a mounting surface and two side surfaces and the body is mounted on the mounting surface.

11. The electric stringed musical instrument according to claim 9, wherein the damper is on the plate spring.

12. The electric stringed musical instrument according to claim 11, wherein the damper is mounted on the plate spring in a cantilever fashion.

13. A method of designing an electric stringed musical instrument to mimic the vibration characteristics of a desired acoustic stringed instrument, the vibration characteristics of the acoustic stringed instrument having two peaks, the electric stringed musical instrument comprising: a string which vibrates by a performance operation, a body which supports the string via a bridge; a pickup sensor which detects vibrations propagated from the string and outputs an electric signal as a function thereof; a supporter having a spring structure which supports the bridge with respect to the body; and a damper which dampens a vibration of the bridge, the damper being spaced apart from the string such that the damper does not contact the string, the method comprising:

selecting a mass of components around the bridge, a spring constant of the supporter, losses due to the bridge and the supporter, a mass of the damper, a spring constant of the damper, and a loss due to the damper such that two peaks appear in vibration characteristics of the electric stringed musical instrument which correspond to the two peaks appearing in the vibration characteristics of the acoustic stringed musical instrument.

14. The method of designing the electric stringed musical instrument according to claim 13, wherein the two peaks that appear in the vibration characteristics of the electric stringed musical instrument during the selecting step correspond to peaks due to (i) a top board of the acoustic stringed musical instrument and (ii) air around a sound hole of the desired acoustic stringed musical instrument and in a resonance body of the desired acoustic stringed musical instrument.

* * * * *